United States Patent [19]

Chapman

[11] 3,964,377

[45] June 22, 1976

[54] INSULATED CLOSURES FOR ATTIC FANS, AND SEALS THEREFOR

[76] Inventor: Lael Ogden Chapman, P.O. Box 13524, Houston, Tex. 77019

[22] Filed: Nov. 22, 1974

[21] Appl. No.: 526,123

[52] U.S. Cl. ..... 98/116; 49/92; 98/121 A; 415/125

[51] Int. Cl.[2] ..... F04D 25/08; F04D 25/14

[58] Field of Search ..... 49/91, 92; 126/285 R; 137/601; 415/125; 98/116, 121 A, 110, 102, 107, 108

[56] References Cited

UNITED STATES PATENTS

| | | | |
|---|---|---|---|
| 1,424,410 | 8/1922 | Hopewell | 49/92 |
| 2,034,231 | 3/1936 | Fox | 98/107 |
| 2,314,003 | 3/1943 | Mader | 98/116 |
| 2,571,374 | 10/1951 | Mayr | 98/116 |
| 2,579,395 | 12/1951 | Pfautsch | 98/116 |
| 2,580,797 | 1/1952 | Koch | 98/116 |
| 2,673,514 | 3/1954 | Hanks | 98/116 |
| 3,081,502 | 3/1963 | Hauck | 49/92 X |
| 3,123,098 | 3/1964 | Bishop | 49/92 X |
| 3,583,171 | 6/1971 | Flynn et al. | 62/303 |

*Primary Examiner*—William F. O'Dea
*Assistant Examiner*—Ronald C. Capossela

[57] ABSTRACT

Insulated closures for attic fans, and the like, one modification of the apparatus having an insulated panel which is removably disposed to cover the attic fan opening, and another modification having insulated tiltable dampers. Complete edge seals for each modification are provided.

11 Claims, 7 Drawing Figures

INSULATED CLOSURES FOR ATTIC FANS, AND SEALS THEREFOR

BACKGROUND AND SUMMARY OF THE INVENTION

A basic problem in the use of attic fans for ventilation is that attic fans of most designs are not insulated, and therefore an uninsulated passage through the ceiling of the home or building is encountered which causes heat losses during the winter months and entrance of heat during summer months. Efforts have been made to provide insulation for attic fans, but none of these efforts has been entirely successful. Attic fans of most designs include movable vanes or dampers which move pivotally to angular positions to permit air passage and which close to flat or horizontal positions to stop air flow. Sealing the edges of such apparatuses is difficult, and has never been completely satisfactorily accomplished.

According to the invention, insulated panels are provided which, according to one modification of the invention, are removable and completely cover the air inlet opening of the attic fan apparatus. According to another modification, the insulating panels are utilized as vanes or dampers for the attic fan unit, and similar seal devices therefor are provided as are provided in the first embodiment. The seals consist of convex elastomeric strips which are contacted under pressure upon closure of the panels or dampers and which provide thoroughly adequate seals so that air passage past the panels or dampers is substantially prevented.

A principal object of the invention is to provide apparatus whereby attic fan inlets are completely closed and insulated. An additional object of the invention is to provide such apparatus utilizing edge seals which substantially completely prevent air flow therepast. Still another object of the invention is to provide such apparatus which is reliable, durable and economical. Yet another object of the invention is to provide insulated panels for attic fan inlets which are removable and yet which may be installed with virtually no effort to seal the air inlet opening of the attic fan. A further object of the invention is to provide attic fans having insulated dampers wherein edge seals for the dampers are provided which are entirely reliable and functional for their intended purpose.

BRIEF DESCRIPTIONS OF THE DRAWINGS

DESCRIPTIONS OF THE PREFERRED EMBODIMENTS

Figure 1:
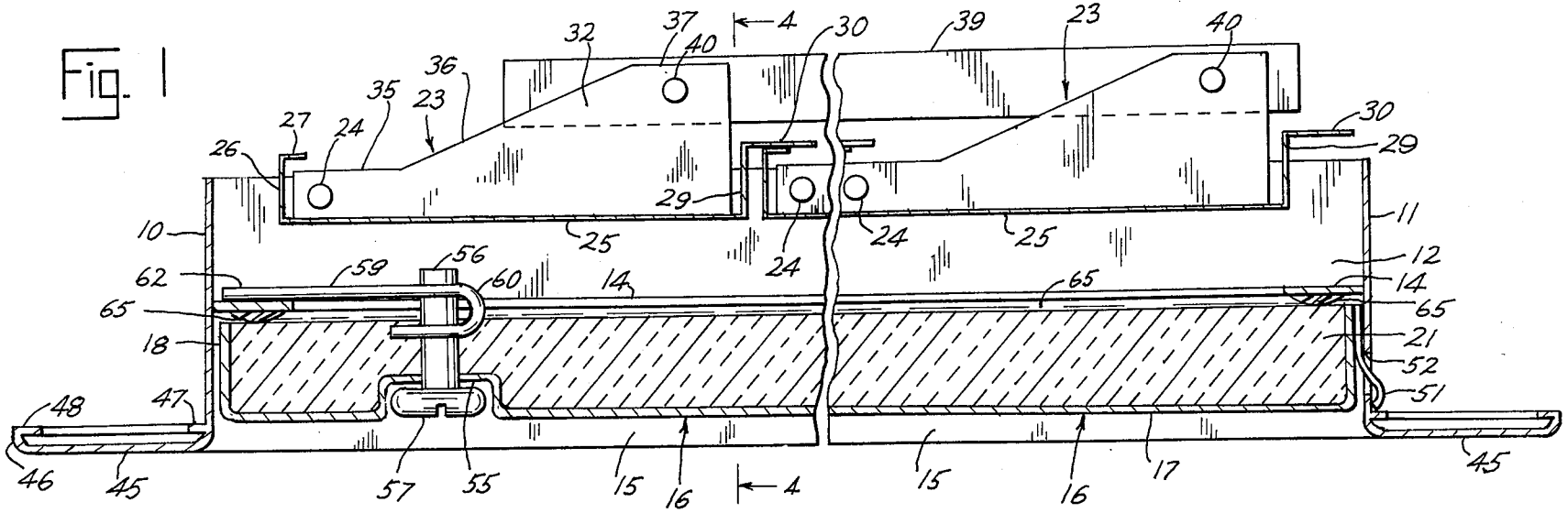
FIG. 1 is a vertical cross sectional view showing an attic fan equipped with a removable insulating panel according to the invention.

Referring now to the drawings, and first to FIGS. 1–5, the housing of the attic fan shown has opposite end walls 10, 11, and opposite mirror image side walls 12, only one of which is shown in FIG. 1. An inwardly directed horizontal flange 14 is affixed around the interior of the housing, midway between its bottom and top, and is affixed to the housing by means not shown, such as by spot welding, brazing, or the like. Below flange 14 there is provided a space 15 within which may be disposed an insulated panel 16 formed by a bottom panel or a plate 17 and surrounding upstanding walls 18. Space 15 is also the bottom portion of the air passage through the attic fan. The interior of panel 16 is filled with insulation 21 of any suitable form. Insulation 21 may be affixed within panel 16 by any suitable means, such as by gluing or bonding of the insulation within the panel. The insulation is coherent so that it will remain in place within the panel even though the panel is moved to any other position than that shown. The flange 14 provides a stop against which the insulated panel is disposed whenever it is installed in the attic fan opening.

A plurality of vanes or dampers 23 are pivotally mounted by rivets 24 to the opposite sidewalls 12 of the attic fan housing. Each damper 23 has a bottom plate 25, an upwardly turned flange 26 at one edge having an inturned flange 27 at its upper end, an upturned flange 29 at its opposite edge having an outwardly directed flange 30 at its upper end, and two oppositely disposed shaped flanges 32 one at each end of the damper. The flanges 32 are narrower at their left hand ends 35 as shown in the drawings, and have an angular edge 36 sloping upwardly to the wider portion 37 adjacent the opposite edge of the damper. The rivets 24, or other suitable fasteners which may be substituted therefor, are disposed through holes in the flanges 32 adjacent the flange 26 adge of the damper.

The plurality of dampers 23 are connected together by longitudinal bars 39 which are pivotally connected by rivets 40 to the high parts of the flanges 32 at the opposite ends of the dampers by rivets 40, as clearly shown in the drawing. When the attic fan blower (not shown) which is disposed above the dampers is turned on, the dampers all open simultaneously under the pressure of flowing air to permit the air drawn in by the blower to be moved into the attic or other space within which the attic fan is located. When the blower is turned off, the dampers assume the closed positions shown in the drawings by gravity.

The attic fan arrangement shown is for illustration only, and does not form part of the invention. Some parts of the attic fan, therefore, are not shown in the drawings, such as for example, end members to seal with flanges 27, 30 and means for preventing over travel of the dampers on closing.

In the usual attic fan, a flange similar to flange 14 will be disposed at the lower side of the air opening 15, and the dampers 23 will be disposed in lower positions immediately thereabove. According to this invention however, the dampers are moved upwardly and the flange 14 is disposed upwardly of its normal position to thereby provide the space 15 for the insulated panel 16.

Disposed outwardly from the lower edges of walls 10, 11 and 12, there is provided a mounting flange 45 having an upturned edge 46 and also having inner and outer flange webs 47, 48 to stiffen and strengthen the structure. The flange 45 is mounted against the ceiling or wall around the attic fan opening in the usual manner.

At the right hand end of the apparatus as shown in FIG. 1, the insulated panel 16 is provided with a plurality of spaced releasable hinges 51. These are in the form of strips which are affixed to the wall 18 of panel 16 at their upper ends and which curve outwardly and downwardly and then inwardly at their lower ends in the form of hooks. Each hinge strip 51 is disposed through an opening 52 in wall 11 immediately above flange 45. When the left hand end of panel 16 is lowered, the hooked formations of the strips 51 can be hung over the lower edge of the openings 52 to support the panel 16 hanging in more or less vertical position. If it is desired to entirely remove the panel, then the hinge strips 51 may be removed entirely out through the openings 52 for this purpose. Reinstallation of the panel is simple because the panel may first be hung in vertical positions by the strips 51 and then pivotally moved upwardly to its horizontal installed position and latched in place.

Figure 4:
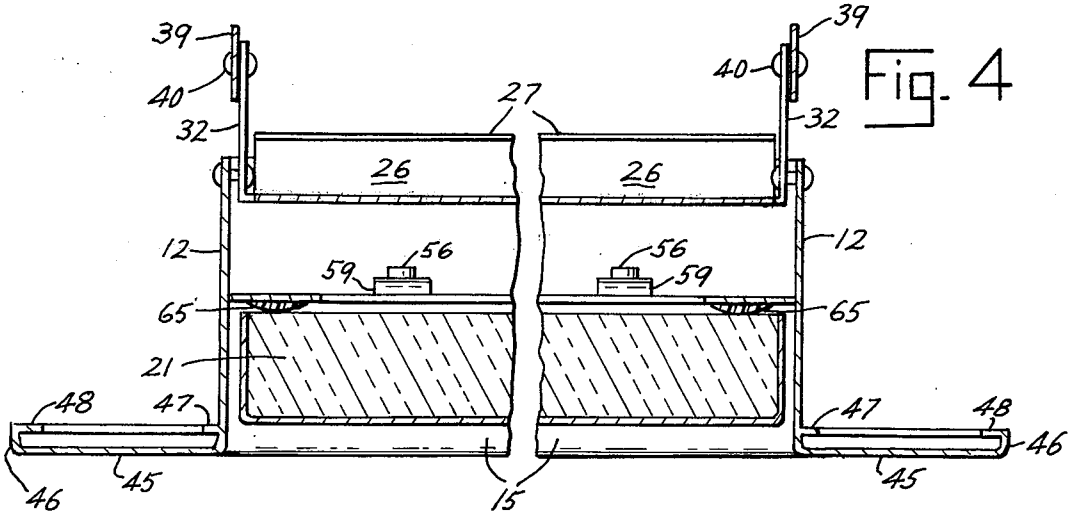
FIG. 4 is a vertical cross sectional view taken at line 4—4 of FIG. 1.

Referring now to FIGS. 1 and 4, the bottom plate 17 of the panel 16 is upset at 55 to form one or more circular recesses having substantially squared sides as shown, spaced across the end of the plate 17. A bar 56 having slotted head 57 is disposed upwardly through an opening at the bottom of the recess. Bar 56 is affixed through circular openings of bar 59 which is U-bent at one end at 60. The openings through which rod 56 is disposed are through the opposite sides of the U-bend. The rod may be affixed to strip 59 in any manner to be stationary thereon. When rod 56 is rotated about its axis, the extending end 62 of bar 59 may be rotated to a position extending above flange 14 to serve as a latch for holding the left hand end of panel 16 in its upward installed position. When rod 56 is rotated to another position, end 62 of bar 59 may be moved to a position not above flange 14 whereby the left hand end of panel 16 may be lowered.

A seal is provided completely around the edges of panel 16 by a convex strip 65 of elastomeric material carried around the lower face of flange 14. Strip 65 is adhered at its flat upper side to flange 14, and extends completely around flange 14 so that the seal extends completely around the periphery of panel 16. As will be clearly understood, no passage of air may occur around the panel 16 once it is installed and latched in place in the described manner.

Figure 3:
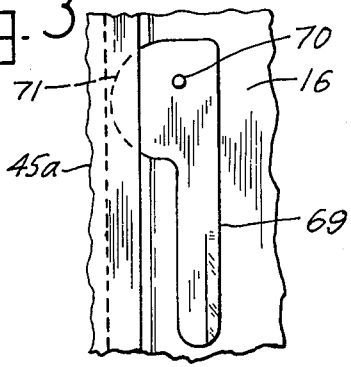
FIG. 3 is a partial bottom view of the apparatus shown in FIG. 2.
Figure 2:
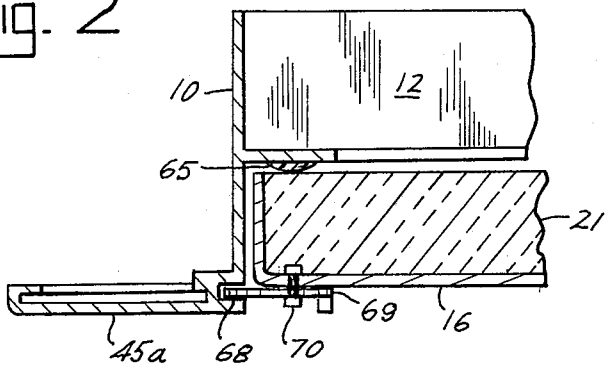
FIG. 2 is a partial vertical cross section showing a modification of the apparatus of FIG. 1.
Figure 7:
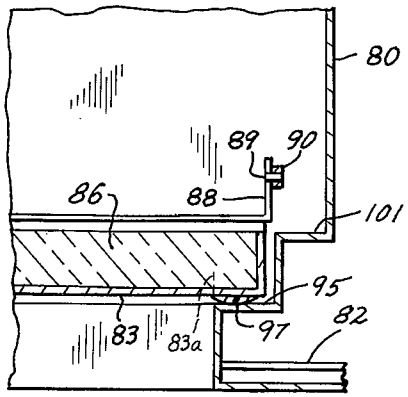
FIG. 7 is a vertical cross section taken at line 6—6 of FIG. 5.

Referring now to FIGS. 2–3, an alternative structure for the apparatus is shown. Portions of the apparatus that are like those shown in FIGS. 1 and 4 will be referred to in FIGS. 2 and 3 by the same reference numerals. The dampers 23 are not shown in FIG. 2. In FIG. 2, the flange **45*a*, which is substituted for flange 45 of FIG. 1, has an inwardly facing recess 68 at the lower side of end wall 10 of the housing. A pivotal twist key 69 is pivotally affixed by rivet or bolt 70 to the lower side of panel 16. When the elongated arm of key 69 is rotated to a position away from flange 45*a*, the key is not engaged in slot or recess 68. When the key is turned as shown in FIG. 3 to a position parallel with wall 10, then the protruding edge 71 of the key extends into recess 68 to latch the panel 16 in place. The removable hinge strip 52 will be disposed at the right hand end of panel 16, as before, and the same seal strip 65 is provided as in the apparatus of FIG. 1.**

Figure 5:
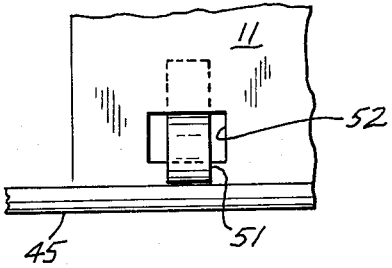
FIG. 5 is a partial elevation showing a hinge used in the apparatuses of FIGS. 1 and 2.
Figure 6:
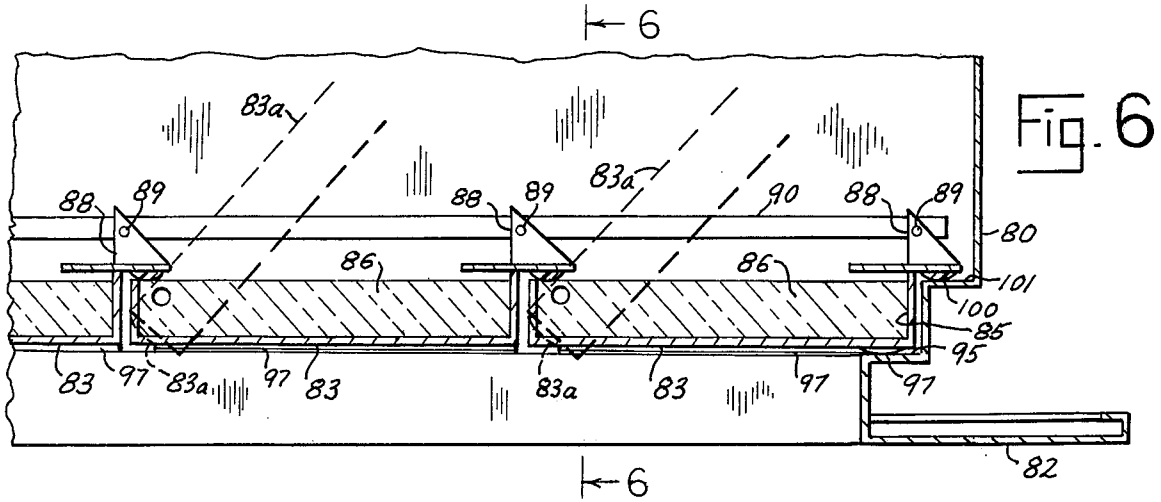
FIG. 6 is a vertical cross sectional view showing an end portion of another form of apparatus according to the invention.

Referring now to FIGS. 5 and 6 of the drawings, another form of apparatus is shown. In this form of apparatus, the attic fan housing has outwardly and upwardly stepped walls 80 at its ends and sides which terminate downwardly in outwardly extending mounting flanges 82. A plurality of dampers 83 are provided, each having a flat bottom wall 84 and upstanding surrounding sides 85 completely therearound, and are filled by insulation layer 86. The side wall 85 of each damper at its right hand side as shown in FIG. 5 is slightly higher, and has affixed thereupon a horizontal plate 87 extending the full length of the damper. The plates 87 have at each of their ends an upturned triangular wing 88 which is pivotally connected by a pin or rivet 89 to a longitudinal rod or bar 90. A bar 90 is disposed at each end of the dampers, only one end being shown in the drawings. The lower step 92 of the end and sidewalls forms an upwardly facing shoulder against which a convex elastomeric seal strip 97 is seated when the dampers are closed. The seals 97 extend along the edges of the terminal dampers at each end of the attic fan, and along the ends of all of the dampers. When the dampers are opened to positions **83*a* then air drawn by the blower may pass through the attic fan opening. When the dampers are closed when the blower is not operating as shown by their solid line positions in FIG. 5, then substantially no air flow may occur. The dampers are relieved slightly at 84*a* opposite shoulders 101** to provide opening clearance.

At the underside of the right hand edge of each strip 87 there is affixed a convex elastomeric sealing strip 100, which when the dampers are closed seats either against upper step 101 of the end walls or against the upper surface of the adjacent damper panel as shown.

The sealing strips 97 along the ends of the dampers seat against the lower shoulder 95 along the sides of the apparatus.

The sealing strips 65, 97 and 100 provide very reliable seals which are energized by pressure of the panels or dampers thereagainst. Since there is no abrasion against these seals, they will last indefinitely. The seals are greatly superior to other forms of seals for attic fans, and amount to an improvement in the art. Use of the seals reduces manufacturing costs and simplifies manufacture, as no close tolerances are required to make the seals completely effective.

As will by now be clear, the invention affords attic fan apparatus having closure means which prohibits air flow through the air opening of the attic fan when the apparatus is closed. In one form, a removable panel may be disposed in place to completely seal the attic fan opening. In the other form, the attic fan dampers themselves provide substantially complete restriction of air flow so that heat losses do not occur. In both forms, the described panels are insulated as shown in the drawings to reduce heat losses through the attic fan openings.

While preferred embodiments of the invention have been described and shown in the drawings, many modifications thereof may be made by a person skilled in the art without departing from the spirit of the invention, and it is intended to protect by Letters Patent all forms of the invention falling within the scope of the following claims.

I claim:

1. Insulated closure for an attic fan air inlet, comprising an attic fan having an air inlet, said attic fan having plural parallel elongate vanes across said air inlet rotatable to open and closed positions with respect to said air inlet, a frame around said air inlet at the entrance to said air inlet, said vanes being spaced from said entrance to said air inlet to provide a recess space over the area of said air inlet, insulated panel means conforming in shape to said air inlet and disposable in a closed position within said recess space of said air inlet and flush with the entrance to said air inlet to cover said vanes and to close said air inlet, said panel means being movable from said closed position covering said vanes to open said air inlet, and peripheral seal means around at least one of said panel means and air inlet to seal therebetween when said panel means is in said closed position.

2. Combination of claim 1, said panel means being movably affixed in said air inlet by pivotal connection means.

3. Combination of claim 2, said panel means comprising a flat outer plate having inwardly depending walls therearound to provide an insulation space, and a layer of insulation material affixed in said insulation space.

4. Combination of claim 1, said peripheral seal means comprising an elongate strip of elastomeric material having a flat side and a convex side the edges of which coincide, the flat side of each said strip being adhered to one of a said panel means and said air inlet.

5. Combination of claim 1, said panel means comprising a single unitary panel comprising a flat outer plate and inwardly depending edge walls forming an insulation space therewithin, a layer of insulation affixed in said insulation space, releasable hinge means at one edge of said panel engaged with one side of said air inlet, latch means at another edge of said panel adapted to releasably engage another side of said air inlet, whereby said panel may be pivotally opened and removed from said air inlet.

6. Combination of claim 5, each said releasable hinge means comprising a shaped strip affixed at its inner end to one edge wall of said panel and curving outwardly and then inwardly of the edge wall in the form of a hook, and an opening in said one side of said air inlet to receive said hook.

7. Combination of claim 6, each said latch means comprising a twist latch carried by said panel and means at the side of the air inlet adapted to receive a portion of said twist latch rotated thereinto.

8. The combination of claim 1, including releasable hinge means connecting one edge of said panel to one side of the air inlet and releasable latch means for connecting another edge of said panel to another side of the air inlet.

9. Combination of claim 8, each said releasable hinge means comprising a shaped strip affixed at its inner end to one edge wall of said panel and curving outwardly and then inwardly of the edge wall in the form of a hook, and an opening in said one side of said air inlet to receive said hook.

10. Combination of claim 9, including strip seal means around the edges of at least one of said panel and said air inlet to form an airflow diminishing seal between said panel and air inlet.

11. In an attic fan apparatus of the type having plural pivotal parallel dampers movable to open and close the air inlet, the improvement comprising insulated damper panels each comprising a flat outer plate having inwardly depending side walls therearound to form an insulation space therebetween and having a layer of insulation material affixed in said insulation space, said damper panels being non-overlapping and being in the same plane when closed, strip seal means around the edges of at least one of said damper panels and said air inlet to form airflow diminishing seals between said dampers panels and said air inlet, and strip seal means between adjacent damper panels.

* * * * *